United States Patent [19]

Jackson

[11] 4,240,578

[45] Dec. 23, 1980

[54] SOLID BOWL DECANTER CENTRIFUGES OF THE SCROLL DISCHARGE TYPE

[76] Inventor: Joseph F. Jackson, 1 W. Royd Villas, Kingcross Rd., Halifax, England

[21] Appl. No.: 900,215

[22] Filed: Apr. 26, 1978

[30] Foreign Application Priority Data

May 4, 1977 [GB] United Kingdom ..... 18612/77

[51] Int. Cl.[3] ..... B04B 1/20; B04B 9/10

[52] U.S. Cl. ..... 233/7; 233/24

[58] Field of Search ..... 233/7, 23 R, 24, 19 R

[56] References Cited

U.S. PATENT DOCUMENTS

| | | | |
|---|---|---|---|
| 2,955,753 | 10/1960 | O'Conor et al. | 233/24 X |
| 3,126,337 | 3/1964 | Smith | 233/7 X |
| 3,734,399 | 5/1973 | Oas | 233/7 |
| 4,073,431 | 2/1978 | Jager | 233/7 |
| 4,085,888 | 4/1978 | Jager | 233/7 |

FOREIGN PATENT DOCUMENTS

| | | | |
|---|---|---|---|
| 2070485 | 8/1971 | France | 233/23 R |
| 429850 | 1/1975 | U.S.S.R. | 233/7 |

*Primary Examiner*—George H. Krizmanich

*Attorney, Agent, or Firm*—Beveridge, DeGrandi, Kline & Lunsford

[57] ABSTRACT

A solid bowl decanter centrifuge comprising a solid, generally cylindrical bowl having a liquids outlet at one end and a solids outlet at the other end, and adapted to be rotated at a first speed. Inlet pipework enables influent to be introduced to the interior of the bowl. A scroll conveyor is mounted for rotation within the bowl at a second speed. A first motor has its output shaft coupled to the scroll conveyor whereby the motor speed determines the differential speed of the conveyor relative to the bowl. A control mechanism is adapted to measure the torque applied to the scroll conveyor and to control the speed of the scroll conveyor in dependence upon the measured torque, a second pump being adapted to pump flocculant into said inlet pipework at a rate dependent upon the torque controlled differential speed of the scroll conveyor.

8 Claims, 8 Drawing Figures

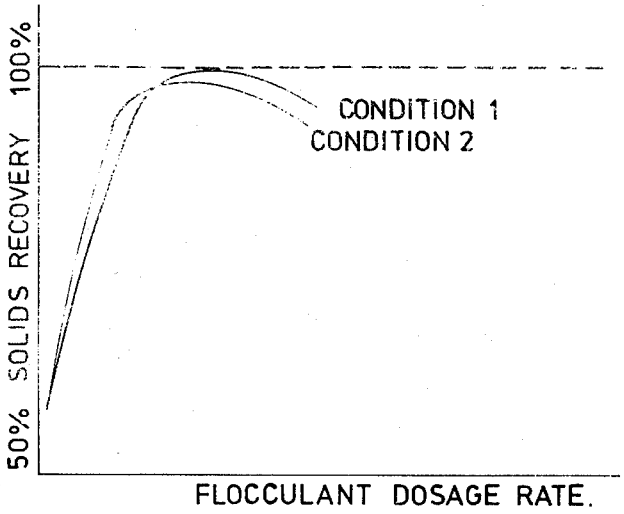
-FIG.2-
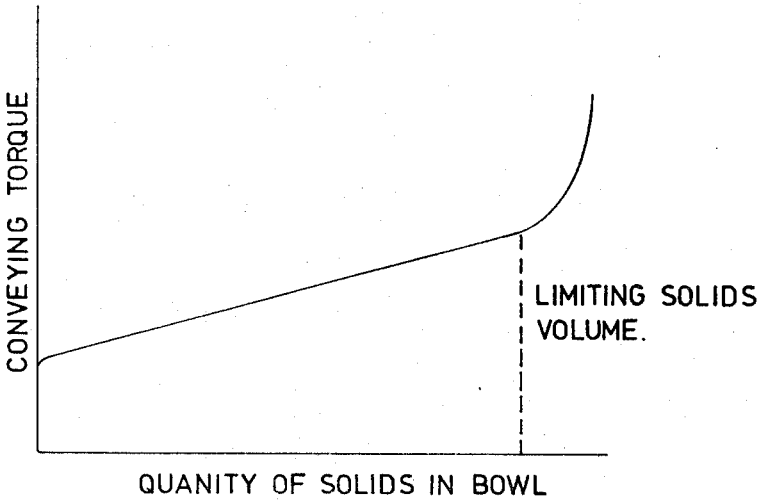
-FIG.3-

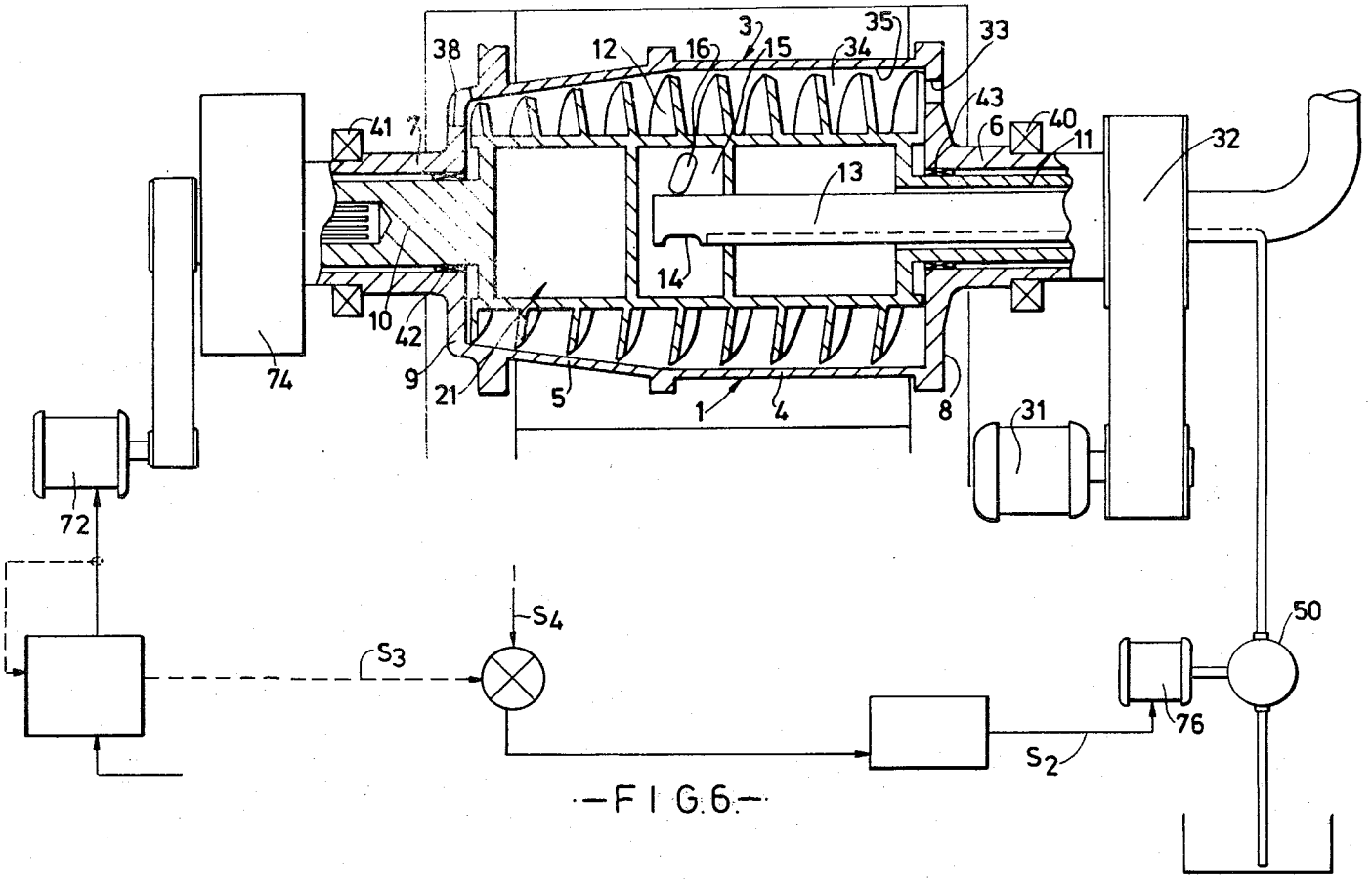
—FIG.6—

SOLID BOWL DECANTER CENTRIFUGES OF THE SCROLL DISCHARGE TYPE

This invention relates to solid bowl decanter centrifuges of the scroll discharge type.

The application of solid bowl decanter centrifuges to solid/liquid separation processes often entails the introduction of flocculating or coagulating reagents to assist sedimentation of suspended solids under the action of centrifugal force. Thus, improvement in sedimentation occurs as a result of the aggregation of small primary particles to larger aggregates, these larger aggregates settling at a greater rate than the primary particles because of their increased size.

One such application of decanter centrifuges is the processing of sewage sludge where the feed suspension influent consists of primary, secondary or digested sludge or a mixture of these. In the final centrifugal dewatering of sewage sludge, conditioning by the addition of a polymeric flocculating agent is invariably necessary to achieve an acceptably clear discharge effluent. The weight of flocculant introduced to condition a given weight of sludge in a given centrifuge operating at a particular throughout is dependent upon the characteristics of the sludge being processed, the flocculant employed and the quantity of suspended solids in the feed.

Normally the characteristics of a particular sludge are reasonably constant, with the exception of solids content, so that, by the selection of an appropriate flocculant, the main variations in dosage rate occur as a result of changes in the concentration of suspended solids particles in the sludge being processed. This variation may typically be between 2 and 5% expressed on a weight for weight basis over an extended operating period.

To achieve the best conditioning of the sludge, it is desirable that the dosage of flocculant should be continuously controlled in response to changes in the quantity of solids in the feed suspension. Generally there is a sharply defined optimum flocculant dosage rate, in excess of which the efficiency of the conditioning is reduced.

Various methods have been proposed for controlling the flocculant dosage rate in response to changes in the suspended solids concentration occuring in the influent material. One such method entails measuring the clarity of the discharged effluent and automatically adjusting the dosage of flocculant to maintain a satisfactory liquor. However, this method is unsatisfactory, owing to problems in measuring the true turbidity of the effluent.

It is a principle object of the present invention to provide an improved means for controlling the flocculant dosage rate in response to changes in the suspended solids concentration in the influent.

In another aspect of decanter centrifuge operation, it is known to measure the torque exerted on the scroll and to use this as a measure of the consistency and dryness of the solids in the bowl. When the motor driving the scroll is of the hydraulic type, then the change in hydraulic fluid pressure across the motor is a measure of this torque and may be used to control its rotational speed and hence the consistency of the solids.

In accordance with the present invention, the flocculant dosage is arranged to be controlled in response to the torque controlled rotational speed of the scroll.

Preferably, this is achieved by incorporating a further hydraulic motor in one of the hydraulic fluid supply lines to the hydraulic motor driving the scroll whereby the second hydraulic motor is driven at a speed dependent upon the rate of supply of fluid to the first motor and hence to the rotational speed of the latter motor, the second hydraulic motor being utilised to drive a dosing pump for the supply of flocculant to the influent material to the centrifuge.

The invention will be further described, by way of example, with reference to the accompanying drawings, in which:

FIG. 2 is a graph of experimental curves of solids recovery against flocculant dosage rate;

FIG. 3 is a graph of conveyor torque against quantity of solids in the bowl;

FIG. 6 is a partially sectioned view of a still further embodiment.

Figure 1:
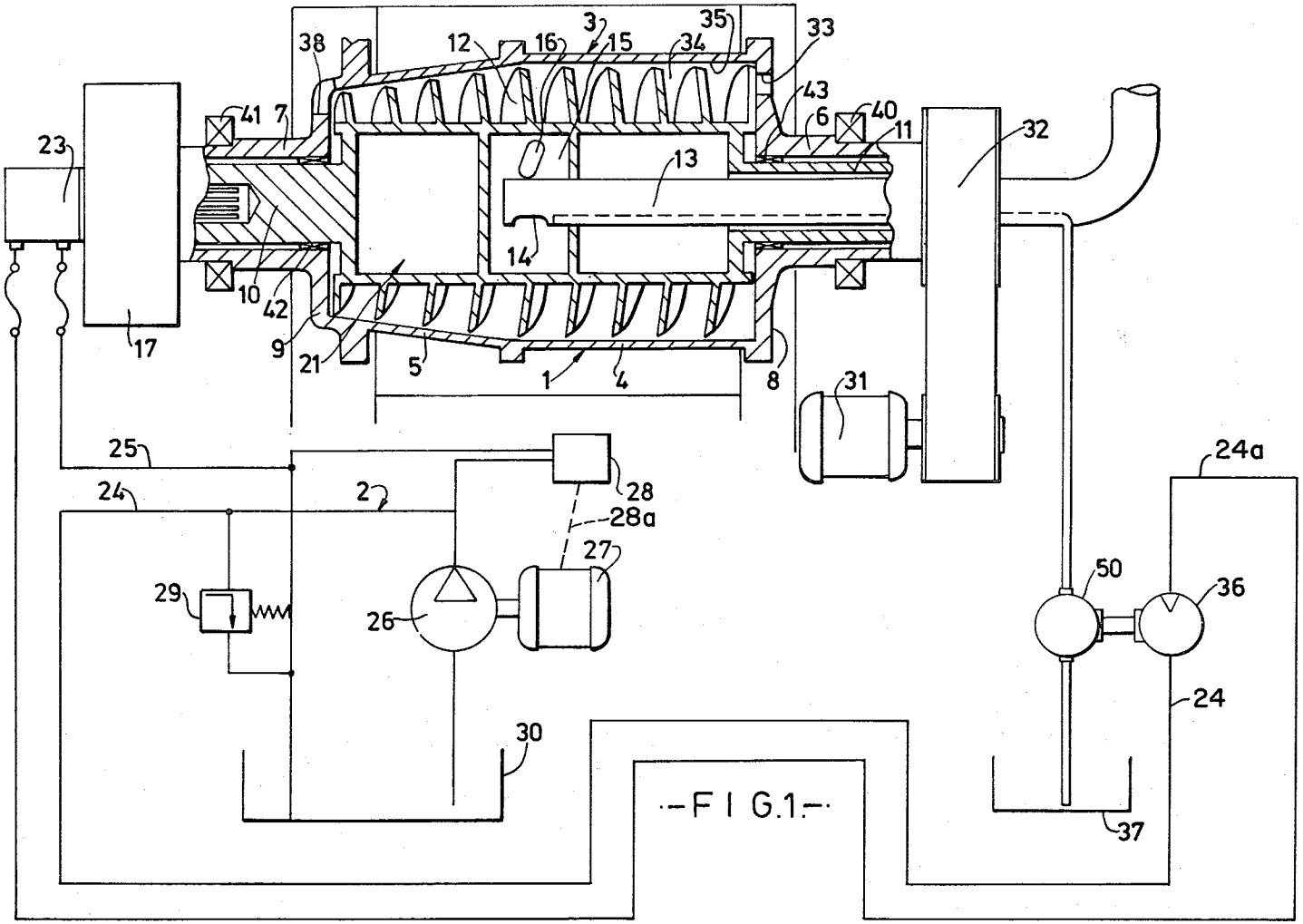
FIG. 1 is a section of a solid bowl decanter centrifuge of the scroll discharge type, embodying the present invention.

Referring to the drawing, the illustrated solid bowl decanter centrifuge 1 has a centrifuge bowl 3 which includes a cylindrical portion 4 and a tapered portion 5 terminating in circular end plates 8 and 9, respectively. Hollow end shafts 6 and 7, integrally formed with the centrifuge bowl 3, project from the circular end plates 8 and 9 and are journalled in bearings 40,41. A scroll 21, having end shafts 10 and 11 journalled in bearings 42 and 43, is independently rotatable within the bowl and includes a central cylindrical portion having within it a chamber 15 for the reception of influent from orifice 14 of an inlet pipe 13 and is furnished with an Archimedean screw 12 whose contour closely follows that of the portions 4 and 5 of the centrifuge bowl. The shaft 10 is driven by the output shaft of a slow speed, high torque hydraulic motor 17 whose body is rigidly connected to the shaft 7 for rotation therewith. The motor 17 is arranged to be driven, via a hydraulic rotary coupling 23, by a hydraulic circuit 2 which includes connecting pipes 24, **24*a* and 25 through which hydraulic fluid is pumped to the motor 17 by a positive variable displacement pump 26. An electric motor 27, controlled by a control mechanism 28 as shown diagrammatically by broken line 28*a*, drives the pump 26 at a pumping rate which is dependent on the hydraulic pressure difference across the motor 17. Hydraulic fluid is stored in a reservoir 30, the circuit 2 being protected from over pressure by a relief valve 29**.

The apparatus so far described above is already known, its method and mode of operation being as follows.

After the centrifuge bowl has been set in rotary motion by means of an electric motor 31 and belt 32, liquid/solids influent is dosed with a flocculant in the inlet pipe 13 and enters into the chamber 15 through orifice 14. The influent passes through the openings 16 into region 34 where, by centrifugal action due to the rotation of the centrifuge bowl, solid matter suspended in the influent accretes at the inner surface 35 of the bowl. Residual liquid leaves the bowl through an aperture 33 in the circular end plate 8, the aperture 33 being disposed radially inward of the inner surface 35 to form a weir. Meanwhile, the solid matter is conducted out of the bowl through holes 38 in the end plate 9 by the screw 12 which is rotated by the hydraulic motor 17.

As already mentioned above, the characteristics of a particular sludge are normally reasonably constant, with the exception of solids content so that, by the selection of an appropriate flocculant, the main variations in the dosage rate occur as a result of changes in the concentration of suspended solids particles in the sludge being processed.

To achieve optimum conditioning of the sludge, it is desirable that the dosage of flocculant should be continuously controlled in response to changes in the quantity of solids in the feed suspension. Generally, there is a sharply defined optimum flocculant dosage rate and a rate in excess of this optimum will promote a reduction in the efficiency of conditioning. This is illustrated graphically in FIG. 2 in which the abscissa-axis denotes the rate at which flocculant is introduced into the feed suspension, expressed as the amount by weight per unit weight of dry solids processed and the ordinate-axis denotes the quantity of solids recovered as a percentage of the total suspended solids in the feed.

It may be seen from the experimental results given in FIG. 2 that for the two different operating conditions shown, an optimum flocculant dosage rate exists above which a deterioration in solids/liquids separation occurs. Apart from the benefits of enhanced separation efficiency, operation at the optimum flocculant dosage rate over a period of time can obviously provide savings in running costs by reducing the total flocculant consumption. It is also apparent from the characteristic shape of the curves shown in FIG. 2, that the tendency in practice with a set dosage system is to increase the rate to a nominal operating point corresponding to the lower negative slope range of the curve occurring after the optimum value. This obviously results generally in an excessive consumption of flocculant.

The operation of decanter centrifuges on sewage sludge dewatering invariably entail variations in the concentration of suspended solids in the feed. At any time the quantity of solids contained within the centrifuge bowl is a function of the influent rate, the differential speed between bowl and discharge scroll and the quantity of suspended solids contained in the feed suspension. To maximise the dryness of discharged solids, it is desirable that the conveyor be run at as low a differential speed as possible to increase the residence time over which the solids are subjected to centrifugal dewatering. For a given feed rate, the quantity of solids contained within the bowl depends on the time integral of both the quantity of suspended solids in the feed and the conveyor differential speed. An increase in suspended solids concentration yields an increasing quantity of solids within the bowl which eventually stabilises at a greater quantity than the initial value. Conversely, an increase in conveyor differential speed promotes a reduction in quantity of solids within the bowl which eventually stabilises to a level below the initial value.

If the operating conditions of a decanter centrifuge are such that the maximum solids volume within the bowl is being utilised, then the solids residence time is maximised and the centrifuge will perform at its optimum setting in terms of solids dryness. However, in the event of an increase in solids concentration in the feed occurring, the solids capacity of the bowl will be exceeded causing the machine to plug and preventing its effective operation.

By automatically controlling conveyor speed in response to the torque necessary to convey the solids, the centrifuge may be continuously operated near to its optimum setting.

For a particular type of feed suspension and constant centrifuge bowl rotational speed, the torque necessary for conveying is substantially proportional to the quantity of solids within the bowl. Secondary effects modify this idealised relationship slightly and the dryness of the discharge solids has a minor influence on the required conveying torque. The actual relationship is of the form illustrated in FIG. 3 where the abscissa-axis denotes the quantity of solids in the bowl and the ordinate-axis shows the required conveying torque. A low finite driving torque is normally necessary to overcome frictional resistance when the conveyor is empty of solids. At the opposite extreme condition when the limiting solids volume of the bowl is exceeded, a steep increase in torque is required due to plugging. Between these two extremes, the relationship connecting conveying torque and quantity of solids within the bowl is substantially linear if the solids dryness at discharge is assumed constant. This permits the measured conveyor driving torque to be utilised to automatically control the conveyor speed and optimise machine performance by maintaining its operating condition just within the limiting solids handling capacity, thus maximising solids residence time and dryness.

Figure 4A:
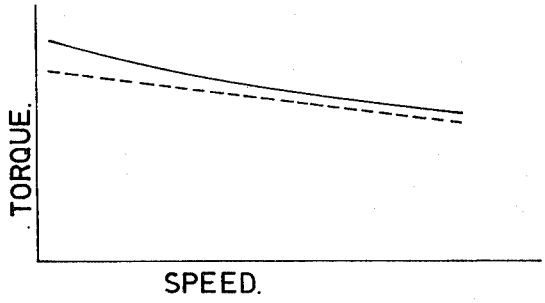
FIG. 4A is a graph of torque against conveyor differential speed.
Figure 4B:
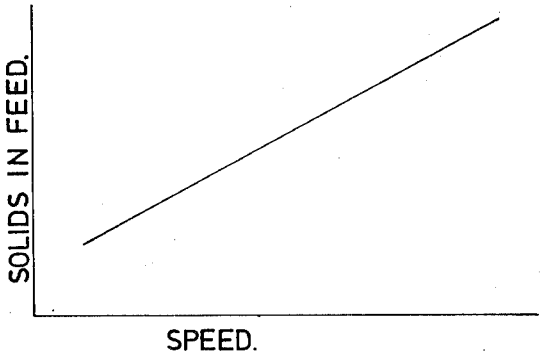
FIG. 4B is a graph of solids in feed against conveyor differential speed.
Figure 4C:
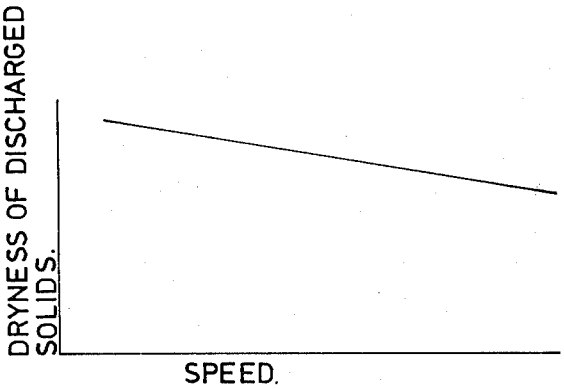
FIG. 4C is a graph of dryness of discharged solids against conveyor differential speed.

The torque/speed relationship obtained by varying the quantity of solids in the feed suspension is illustrated in FIG. 4A where the abscissa-axis denotes the limiting conveyor differential speed below which plugging will occur and the ordinate-axis indicates the necessary conveying torque corresponding to this speed. FIG. 4B shows the variation of suspended solids in the feed against speed and FIG. 4C shows the variation in dryness of the discharge solids, both curves B and C corresponding to the torque speed relationship shown in A. Referring to these graphical relationships it will be appreciated that a reduction in solids concentration in the feed permits a similar reduction in conveying speed to be made and the increased residence time of solids in the bowl yields an increase in solids dryness with a corresponding small increase in torque level from its original value. This accounts for the slight negative slope of the torque speed characteristic shown in FIG. 4A.

Control of conveyor speed in response to torque entails the provision of an automatic system with a torque/speed characteristic generally of the form shown by the discontinuous line in FIG. 4A such that the operation of the centrifuge is restricted to just below the limiting condition shown by the continuous line defining its maximum capacity.

Thus, with reference again to FIG. 1, the consistency and dryness of the solid matter leaving the centrifuge bowl 3 is reflected in the torque exerted on the scroll 21 in conveying it. This torque brought to bear on the scroll 21 gives rise to a proportional hydraulic pressure drop across the supply terminals of the motor 17 which is utilised in the control mechanism 28 to determine the pumping rate of the positive variable displacement pump 26. That is to say, the pressure difference across the hydraulic motor 17 is used, in accordance with the known technique described above to control the speed of the motor so as to stabilize the consistency of the solid matter.

In addition to the control just described, an optimum conditioning of the influent is achieved by permitting the dosage of flocculant to be automatically adjusted in response to variations in the suspended solids content of the feed material.

Since as a result of the aforegoing control the solids content of the feed at any instant is substantially proportional to the difference between the rotational speeds of the centrifuge bowl and the scroll, a second positive displacement hydraulic motor 36 introduced in either line 24 or 25 (shown in FIG. 1 in line 24) will have a rotational speed in direct relationship to this difference and also proportional to the suspended solids content of the feed suspension. As shown in FIG. 1, the motor 36 is in line 24 which includes a segment 24*a*.

This second motor 36 (see FIG. 1) drives a flocculant dispensing pump 50 thereby permitting fully automatic control of the dosage of flocculant from a reservoir 37 to the influent inlet pipe 13 in response to changes in solids concentration. Because the power necessary for driving the flocculant dosing pump 50 is small compared with that needed to drive the scroll motor 17, the pressure difference across the motor 36 does not significantly detract from the pressure available for driving the motor 17.

Summarizing the operation of the apparatus, the controls 28, being responsive to the hydraulic pressure drop across the terminals of the motor 17, cause the motor 27 to drive the pump 26 at a pumping rate which is dependent on the quantity of solids in the bowl and the corresponding torque required to drive the scroll 21. In turn, because the flocculant pump 50 is driven by a motor 36 in the hydraulic lines 24 and 24*a* which drive the scroll drive motor 17, the flocculant is pumped into the infeeding material at a dosage rate which is proportional to the speed of the motor 17 and scroll 21.

Initial setting of the desired relationship between flocculant dosage and scroll speed may be conveniently achieved by employing a variable delivery dosing pump, a variable ratio drive between the second hydraulic motor and dosing pump or by the use of a hydraulic motor of the variable volumetric displacement type, or by introducing upstream of the motor a valve to divide the flow so that a fixed ratio of the total flow is by-passed in parallel with the dosing pump motor.

The above-described system depends on the fact that the scroll conveyor is driven by a hydraulic motor. However, an electrical system may equally well be employed to drive the scroll conveyor and to automatically control flocculant dosage rate in response to changes in solids concentration in the feed material in a similar manner to the above-described hydraulic system. In the description of the embodiments of FIGS. 5 and 6 which follows, parts common to FIG. 1 have been given the same referance numerals as in FIG. 1.

Low speed, high torque electric motors are not available having sufficient power consistent with small overall size to permit them to be used without a mechanical gear reduction in an identical manner to the aforegoing hydraulic arrangement and it is necessary to employ a high speed motor and gearbox.

Figure 5:
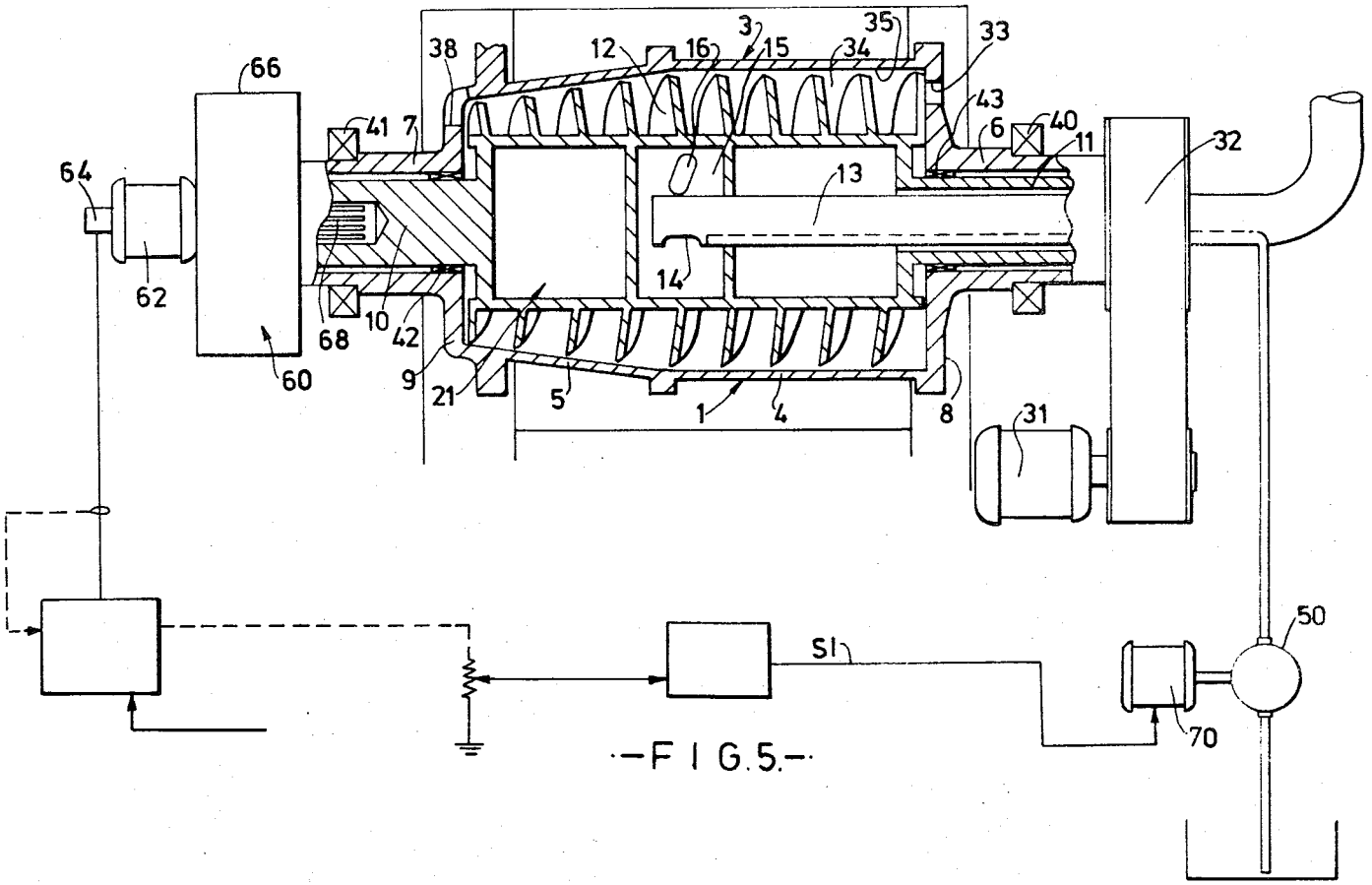
FIG. 5 is a partially sectioned view of a further embodiment of centrifuge incorporating the invention.

Two alternative methods are described in connection with FIGS. 5 and 6. The first arrangement (FIG. 5) employs a mechanical reduction gearbox 60 and coaxially connected electric motor 62 mounted on the centrifuge bowl 3 and rotating with it to replace the slow speed hydraulic motor 17. Slip-rings 64 are provided to permit electrical power to be conveyed to the rotating motor 62 and gearbox 60. The outer housing 66 of the gearbox 60 and motor 62 are connected to the centrifuge bowl 3 and rotate with it. The output shaft 68 of the gearbox is connected to the conveyor 21 and drives this at differential speed.

If the electric motor 62 is a D.C. electric motor, the armature current may be conveniently employed to assess the motor driving torque and the speed of the motor 62 controlled to give the preferred torque speed arrangement illustrated in the graph of FIG. 4A. By employing a signal S proportional to the rotational speed of the first motor 62 for controlling a second electric motor 70 driving the flocculant dosing pump 50, an action similar to that afforded by the hydraulic system previously described, in which dosage rate is automatically controlled in response to changes in the quantity of solids processed, can be achieved.

An alternative arrangement is illustrated in FIG. 6 which permits the elimination of slip-rings for introducing power to the first electrical motor 72. In this particular case, the differential speed of the conveyor 21 is equal to the centrifuge bowl rotational speed less the speed the electric motor 72 which drives the gearbox 74 multiplied by the gearbox reduction ratio. In this arrangement, a reduction in conveyor differential speed is achieved by an increase in the speed of the electric motor 72 driving into the gearbox. It will be appreciated that with this arrangement an increase in motor speed provides a reduction in conveyor differential speed and it is necessary to employ a signal $S_2$ for controlling the second motor 76 used for driving the flocculant dosage pump 50 which is derived by subtracting a signal $S_3$ proportional to the first motor speed from a reference voltage $S_4$ and using this to control the speed of the second motor 76 such that this is in proportion to the signal $S_2$.

I claim:

1. In a solid bowl decanter centrifuge comprising a solid, generally cylindrical bowl having a liquids outlet at one end and a solids outlet at the other end, means for rotating the bowl at a first speed, inlet pipework for introducing influent to the interior of the bowl, a scroll conveyor mounted for rotation within the bowl at a second speed, a first motor whose output shaft is coupled to the scroll conveyer to drive the scroll conveyor at a differential speed relative to the bowl, and a control means for measuring the torque applied to the scroll conveyor and for controlling the speed of the scroll conveyor in dependence upon the measured torque, the improvement comprising a pump means for pumping flocculant into said inlet pipework at a rate dependent upon the differential speed of the scroll conveyor relative to the bowl.

2. A solid bowl decanter centrifuge comprising a solid, generally cylindrical bowl having a liquids outlet at one end and a solids outlet at the other end, means for rotating the bowl at a first speed, inlet pipework for introducing influent to the interior of the bowl, a scroll conveyor mounted for rotation within the bowl at a second speed, a first hydraulic motor whose body is connected to the bowl and whose output shaft is connected to the scroll conveyor to drive the scroll conveyor at a differential speed relative to the bowl, a first pump for supplying hydraulic fluid to said first hydraulic motor, a control means for controlling the pumping rate of said first pump in dependence upon the hydraulic pressure difference across the hydraulic motor, and a second pump means for pumping flocculant into said inlet pipework at a rate dependent upon the torque controlled differential speed of the scroll conveyor relative to the bowl.

3. A centrifuge according to claim 2 wherein said first hydraulic motor has a hydraulic fluid supply line, comprising a second hydraulic motor for driving said second pump, said second hydraulic motor being disposed in the hydraulic fluid supply line to the first hydraulic motor driving the scroll conveyor to drive the second hydraulic motor at a speed dependent upon the rate of supply of fluid to the first motor and hence to the rotational speed of the first motor.

4. A centrifuge according to claim 3 wherein the first pump is of the positive variable displacement type.

5. A centrifuge according to claim 3 wherein the second pump is of the positive variable displacement type.

6. A solid bowl decanter centrifuge comprising a solid, generally cylindrical bowl having a liquids outlet at one end and a solids outlet at the other end, means for rotating the bowl at a first speed, inlet pipework for introducing influent to the interior of the bowl, a scroll conveyor mounted for rotation within the bowl at a second speed, an electric motor whose output shaft is connected to the scroll conveyor to drive the scroll conveyor at a differential speed relative to the bowl, a control means for measuring the torque applied to the scroll conveyor by said motor and for controlling the speed of the motor in dependence upon the measured torque and a pump means for pumping flocculant into said inlet pipework at a rate dependent upon the differential speed of the scroll conveyor relative to the bowl.

7. A centrifuge according to claim 6 in which the body of the electric motor is coupled to the bowl so as to rotate therewith, and in which the motor shaft is coupled to the scroll conveyor by a mechanical reduction gear.

8. A centrifuge according to claim 6 in which the motor shaft is coupled to the scroll conveyor via a reduction gear having a housing connected to the bowl so as to rotate therewith.

* * * * *